US012258855B2

(12) United States Patent
Chong et al.

(10) Patent No.: US 12,258,855 B2
(45) Date of Patent: Mar. 25, 2025

(54) METHODS FOR DATA COMPRESSION AND OPTIMIZATION FOR DOWNHOLE TELEMETRY

(71) Applicant: Halliburton Energy Services, Inc., Houston, TX (US)

(72) Inventors: Matthew Hui Chong, Houston, TX (US); Bipin K. Pillai, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 295 days.

(21) Appl. No.: 17/546,382

(22) Filed: Dec. 9, 2021

(65) Prior Publication Data

US 2023/0137394 A1 May 4, 2023

Related U.S. Application Data

(60) Provisional application No. 63/272,886, filed on Oct. 28, 2021.

(51) Int. Cl.
*E21B 47/024* (2006.01)
*E21B 47/002* (2012.01)
(Continued)

(52) U.S. Cl.
CPC ..... *E21B 47/024* (2013.01); *E21B 47/0025* (2020.05); *E21B 47/12* (2013.01); *E21B 47/26* (2020.05)

(58) Field of Classification Search
CPC ..... H03M 7/30; H03M 7/3059; E21B 47/12; E21B 47/13; E21B 47/18; E21B 47/0025; E21B 47/024; E21B 47/26; E21B 49/00; E21B 47/08; G01V 11/00; G01V 11/002; G01V 1/40; G01V 2210/6163; G01V 3/18
See application file for complete search history.

(56) References Cited

U.S. PATENT DOCUMENTS 5,490,221 A * 2/1996 Ransford ..... G16H 50/50 382/130
10,465,504 B2 11/2019 Gao et al.
(Continued)

OTHER PUBLICATIONS

Foreign Communication from Related Application—International Search Report and Written Opinion of the International Searching Authority, International Application No. PCT/US2021/064505, dated Jul. 7, 2022, 10 pages.
(Continued)

*Primary Examiner* — Yoshihisa Ishizuka
*Assistant Examiner* — Carter W Ferrell
(74) *Attorney, Agent, or Firm* — Conley Rose, P.C.; Rodney B. Carroll

(57) ABSTRACT

A method includes obtaining, by a downhole tool, a first shape of sensor data representing one or more characteristics of a wellbore, comparing, by the downhole tool, the first shape with a set of pre-determined reference shapes stored in a downhole memory to select a pre-determined reference shape that can be imposed on the first shape, calculating one or more delta values between the first shape and the selected pre-determined reference shape, and transmitting, by the downhole tool, the pre-determined reference shape and the delta values to a processor at a surface of the wellbore.

20 Claims, 7 Drawing Sheets

(51) Int. Cl.
*E21B 47/12* (2012.01)
*E21B 47/26* (2012.01)

(56) References Cited

U.S. PATENT DOCUMENTS

| | | | | |
|---|---|---|---|---|
| 2009/0192711 | A1* | 7/2009 | Tang | E21B 47/12 702/6 |
| 2011/0279293 | A1* | 11/2011 | Deslandes | H03M 7/24 341/87 |
| 2017/0089195 | A1 | 3/2017 | Yu | |
| 2017/0167247 | A1 | 6/2017 | Gao et al. | |
| 2017/0322332 | A1* | 11/2017 | Cooper | G01V 1/40 |
| 2017/0332157 | A1 | 11/2017 | White et al. | |
| 2020/0241166 | A1* | 7/2020 | Marsh | E21B 47/20 |
| 2020/0325767 | A1* | 10/2020 | Miller | E21B 7/10 |

OTHER PUBLICATIONS

Filing Receipt, Specification and Drawings for U.S. Appl. No. 63/272,886 entitled "Methods for Data Compression and Optimization for Downhole Telemetry," filed Oct. 28, 2021, 39 pages.

* cited by examiner

METHODS FOR DATA COMPRESSION AND OPTIMIZATION FOR DOWNHOLE TELEMETRY

CROSS-REFERENCE TO RELATED APPLICATIONS

This application claims priority to U.S. Provisional Application No. 63/272,886 filed on Oct. 28, 2021. The disclosures of the aforementioned applications are hereby incorporated by reference in their entirety.

TECHNICAL FIELD

Embodiments of the disclosure are directed to mud pulse telemetry in drilling operations. More particularly, embodiments of the disclosure are directed to data compression techniques for downhole telemetry in drilling/logging operations.

BACKGROUND

During drilling operations for the extraction of hydrocarbons, a variety of recording and transmission techniques may be used to measure or record real-time data from the vicinity of a drill bit. These measurements of the surrounding subterranean formations may be made using downhole measurement and logging tools, such as directional drilling tools, measurement-while-drilling (MWD) tools, and/or logging-while-drilling (LWD) tools, which help characterize the formations and aid in making operational decisions.

The downhole measurement and logging tools obtain image data and transmit to a surface using mud pulse telemetry techniques. Communication between the downhole tools and a processor at the surface (or from the surface to downhole tools) may often employ compression methods to compress data transmitted between these devices. In some existing compression methods, the raw image data (corresponding to raw sensor data) may be collected at a predetermined reference point and the downhole tool may transmit delta values between the raw image data and actual sensor data to the surface. These compression methods may work best for small delta values. However, these compression methods may not be beneficial for large delta values.

Furthermore, some existing compression methods may cause a delay in data transmission. Information/data about the geographical properties of the formation surrounding the wellbore gathered downhole may be needed at the surface as soon as any change in the information is acquired. A limiting factor in sending data from the downhole devices to the surface is the speed at which the information may be transmitted within the mud column. The current physical data rate of typical telemetry tools may range from 2-20 bits per second (bps). This limited bandwidth may constrain the volume of real-time data being transmitted to the surface operations to effectively control the drilling tools and build a dense geological model. Thus, a mechanism to optimize the data being transmitted to the surface may be useful for formation evaluation and/or controlling the drilling/logging operations.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
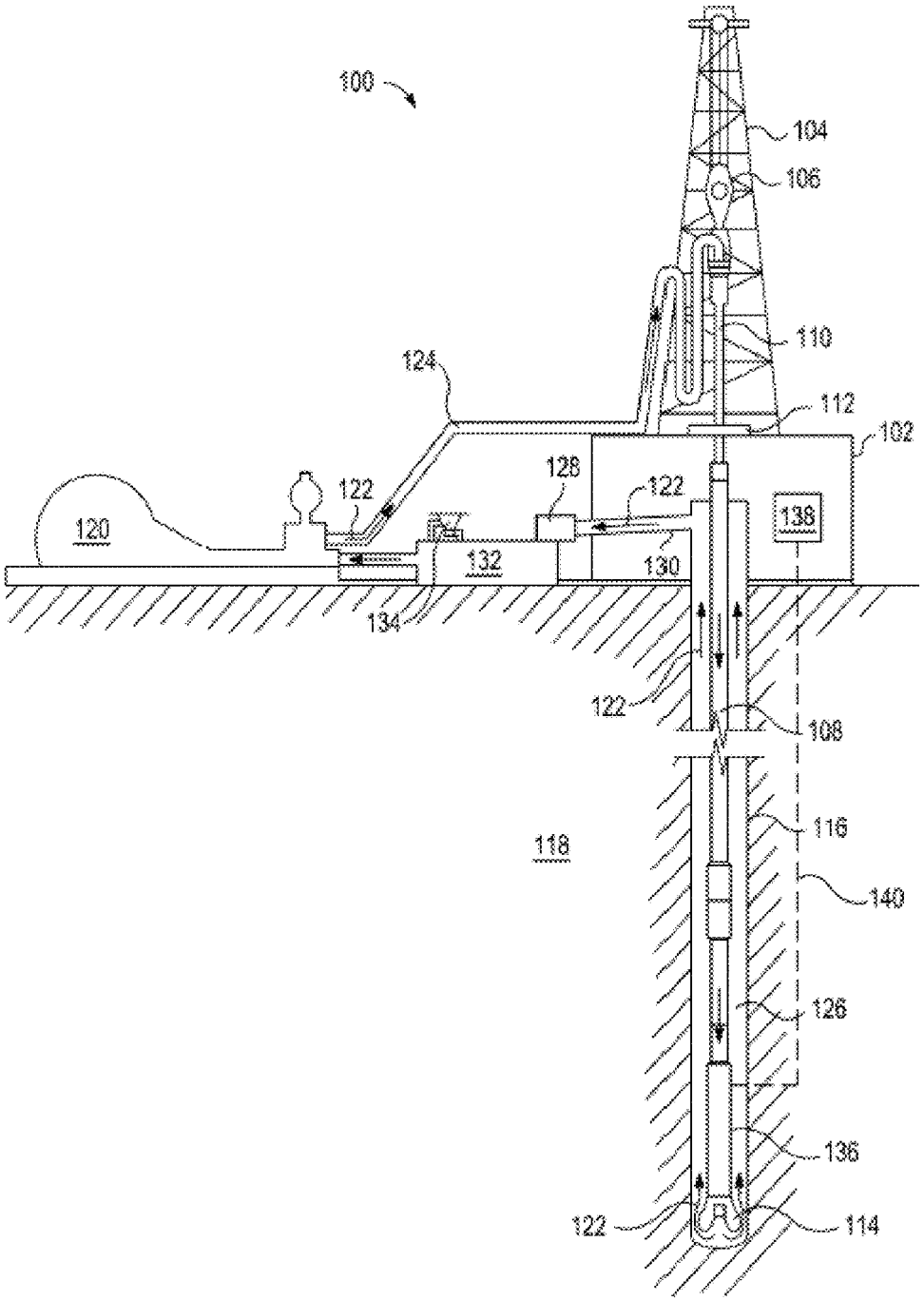
FIG. 1 illustrates an exemplary drilling assembly suitable for implementing the downhole telemetry tools in accordance with embodiments of the present disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Illustrative embodiments and related methodologies of the present disclosure will be described below in reference to FIGS. 1-7 as they might be employed, for example, a downhole tool for acquiring formation property over the course of a drilling operation/a logging operation. The downhole tool may be used to measure formation properties at different depths within a formation as a borehole/wellbore is drilled. Such measurements may be collected by the downhole tool around a section of the borehole to obtain an "image" of the borehole section for one or more formation characteristics at a current depth of the downhole tool. In one or more embodiments, such image data may be collected as the downhole tool rotates within the borehole and binned into a plurality of azimuthal bins according to the azimuthal direction in which the downhole tool was positioned when the data was acquired. For example, Image data may be collected as a set of measured pairs including a formation property measurement and a corresponding angle or azimuthal position of the downhole tool around the circumference of the borehole relative to a predetermined reference point. The image data may be stored in a data structure that can graphically represent the image as a two-dimensional or three-dimensional visualization such as a graph, picture, hologram, etc.

In conventional compression methods, delta values between the image data (corresponding to raw sensor data) collected at the predetermined reference point and actual sensor data may be transmitted to the surface of the wellbore. However, these compression methods may not be beneficial for large delta values and may also cause a delay in data transmission.

As will be described in further detail below, embodiments of the present disclosure may be used to efficiently compress the data and significantly improve the effective data rate of the downhole telemetry according to an image imposition scheme. The image imposition scheme may be used to minimize the number of bits being transmitted to a surface device and to optimize the telemetry data rate. In some embodiments, the disclosed methods may be applied to transmit a downhole image along with the delta values. As these methods minimize the delta values, it may be possible to increase the quality of the image to be transmitted.

Because of the speed at which downhole tools traverse the formations in MWD and LWD systems, well trajectory data such as inclination and azimuth changes may not rapidly change between readings taken by the downhole tools. Based on this fact, and possibly to reduce transmission error propagation and to increase an effective data transmission rate in a mud pulse telemetry system, various embodiments of the present disclosure may use data compression systems and methods that can optimize the bit allocation for transmitting the compressed data uphole with a higher effective transmission rate. For example, instead of transmitting the full data values (e.g., uncompressed data) every time, delta values between previously transmitted data and the information of the current data may be sent. Thus, by compressing the data prior to its transmission, it may be possible to reduce the overall number of bits of information which need to be sent to the surface relative to the same amount of uncompressed data, thus increasing the effective data rate and reducing the data rate demand on telemetry hardware.

In some embodiments, the disclosed methods may be used to group the real-time data that provide similar measurements to minimize the bits required for data transmission. Furthermore, grouping the data that measures the same or similar formation properties may also benefit multi-spacing/frequency resistivity measurements.

The disclosed methods and systems may be applied to any formation property measurements, downhole imaging, or any other measurements having a series of data. The rate of compression may increase as more data gets compressed as of initial transmission of shape and location of the reference shape.

The disclosed methods and systems may Increase the effective data rate, reduce the data rate demand on telemetry hardware, or a combination of both. The mud-pulse telemetry system depends on the number of pulse actuation cycles. By reducing the number of cycles, the repair and maintenance service interval may be extended while improving the system reliability.

Additional features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or Imply any limitation with regard to the environment, architecture, design, or process in which different embodiments may be implemented.

FIG. 1 illustrates an exemplary drilling assembly 100 suitable for implementing the LWD and/or MWD tools described herein. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. [0£325] As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A bottom hole assembly (BHA) including a drill bit 114 is attached to the distal end of the drill string 108 and is driven either by a downhole motor and/or via rotation of the drill string 108 from the well surface. As the drill bit 114 rotates, it creates a wellbore 116 that penetrates various subterranean formations 118. Along the drill string 108, a downhole tool 136 described herein is included.

In the present application, the downhole tool 136 may be capable of measuring properties of the subterranean formation 118 proximal to the wellbore 116. The downhole tool 136 may transmit the measured data wired or wirelessly to a processor 138 at the surface. Transmission of the data is illustrated at link 140 to demonstrate communicable coupling between the processor 138 and the downhole tool 136 and does not necessarily indicate the path to which communication is achieved. In one or more implementations, the processor 138 may be, or may be a part of, a downhole processor located downhole to carry out encoder operations for transmitting the measured data uphole to the surface.

The downhole tool 136 may include one or more of an angle sensor, an azimuthal deep resistivity sensor, an azimuthal focused resistivity sensor, an azimuthal lithodensity sensor, an at-bit inclination sensor, or an at-bit azimuthal gamma ray sensor. For example, the azithumal lithodensity sensor may combine density and photoelectric (Pe) measurements with azimuthal binning of data and an independent acoustic standoff sensor (not shown) for petrophysical evaluation of the subterranean formation 118 (e.g., a reservoir). The downhole tool 136 with the azimuthal lithodensity sensor can obtain measurements relating to formation dip and borehole shape information for geosteering and hole quality applications. In one or more implementations, the downhole tool 136 is constructed with azimuthally responsive sensors distributed azimuthally around a symmetry axis of the downhole tool 136 that make it possible to make measurements of the azimuthal distribution of formation properties without rotating the drill string 108 or sensor package. In one or more implementations, the downhole tool 136 is constructed with an angle sensor to determine sensor data based on measurements obtained from the angle sensor.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (e.g., a mud pit). While illustrated as being arranged at the outlet of the wellbore 116 via the annulus 126, those skilled in the art will readily appreciate that the fluid processing unit(s) 128 may be arranged at any other location in the drilling assembly 100 to facilitate its proper function, without departing from the scope of the disclosure.

In one or more implementations, pressure transducers are mounted in one or more locations along the feed pipe 124. The transducers include signal conditioning electronics that may be used to send electrical signals corresponding to pressure impulses to a surface receiver. The surface receiver may consist of an analog front end that is interfaced to the processor 138. In one or more implementations, the processor 138 may be, or may be a part of, the surface receiver. For mud pulse telemetry, the processor 138 may be interfaced to a telemetry channel, which has a relatively low data rate compared to the demand necessary for successful transmission of images in real-time. The telemetry channel may be an electromagnetic telemetry channel or an acoustic telemetry channel.

The processor 138 may include a portion of computer hardware used to implement the various illustrative blocks, modules, elements, components, methods, and algorithms for analyzing the measurements described herein. The processor 138 may be configured to execute one or more sequences of instructions, programming stances, or code stored on a non-transitory, computer-readable medium. The processor 138 can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium. The memory may store a library of pre-determined shapes (described in more detail below) and, in embodiments implementing processing functionality at least in part with software, instructions to be executed by the processor(s) 138. In some embodiments, the memory may further store raw/initial sensor image data as well as processed sensor image data.

Executable sequences described herein can be implemented with one or more sequences of code contained in a memory. In some embodiments, such code can be read into the memory from another machine-readable medium. Execution of the sequences of instructions contained in the memory can cause a processor 138 to perform the process steps to analyze the measurements described herein. One or more processors 138 in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to the processor 138 for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Figure 2:
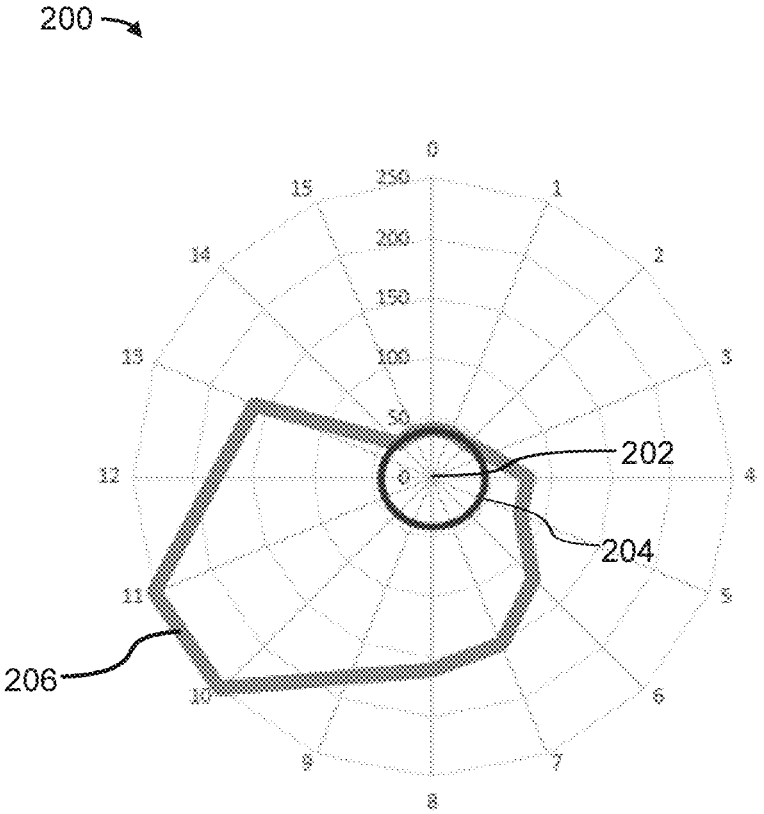
FIG. 2 illustrates a polar plot of sensor data collected by a downhole tool in accordance with a conventional data compression method.

FIG. 2 illustrates a polar plot 200 of sensor data collected by the downhole tool 136 in accordance with a conventional data compression method. As mentioned above, the downhole tool 136 is configured to collect sensor data as the downhole tool 136 rotates within the wellbore 116. In this example, the downhole tool 136 is coupled to the drill string 108, which is rotated about a longitudinal axis along a depth of the wellbore 116. The collected sensor data may be represented as a sequence of coordinates points/data points on the polar plot 200. The polar plot 200 may be an azimuthal plot of the sensor data (or a parameter) measured by the downhole tool 136. The measurement may be from an acoustic caliper, an azimuthally sensitive resistivity tool, or the like. Each data point may include mechanical and/or acoustic information obtained along an azimuthal axis around the borehole at a relatively fixed depth in a formation to provide an image, a shape, a trace, a profile, or a contour of radial dimensions of the wall boundaries surrounding the wellbore 116. In general, the sensor data may represent one or more characteristics of the wellbore 116, such as the shape and overall dimensions of the wellbore 116 or the natural gamma ray activity of the subterranean formation 118 at the wellbore wall as a function of the angle of rotation of the downhole tool 136 with respect to an arbitrary reference (or with respect to magnetic north).

In one or more implementations, as shown in FIG. 2, the downhole tool 136 may collect raw/initial sensor data and actual/real-time sensor data representing coordinates of the downhole tool 136 relative real-time operation data conditions in the subterranean wellbore 116. When a series of the initial sensor data/downhole logging data is arranged on the polar plot 200 based on a predetermined reference point 202 (which is zero in this case) from zero data points to 15 data points, it may form a reference shape 204. In one case, the reference shape may be a circle fora homogeneous formation. However, when an abrupt change in formation properties occurs in real-time, initial data points may be off-center from the reference point 202. These off-centered data points (i.e. real-time/actual sensor data) may form a first shape 206. In some implementations, the first shape 206 may be any form of shape including a circle, an oval, a rectangle, an ellipse; or a subset thereof. In the conventional data compression method, a difference of area between the reference shape 202 and the first shape 206 may equate to the bandwidth required to transmit from the downhole tool 136 to the processor 138. The difference of area may represent delta values to transmit. While this method may work best when the delta values are small, there may be a risk of losing the benefit of compression when the difference between the initial sensor data and the actual sensor data that are being compressed is large. It therefore may be desirable to improve existing compression techniques of downhole sensor data.

Figure 3A:
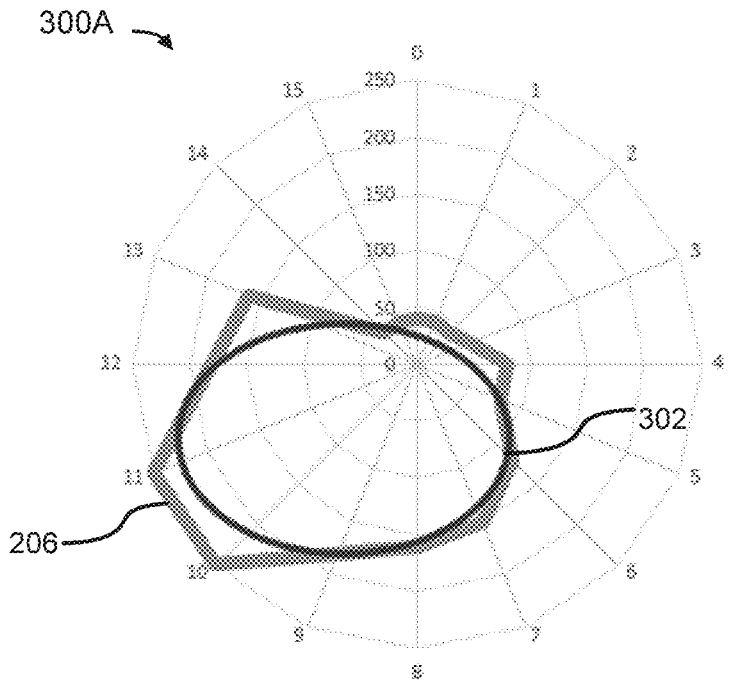
FIG. 3A illustrates a polar plot of sensor data collected by a downhole tool in accordance with embodiments of the present disclosure.

FIG. 3A illustrates a polar plot 300A of sensor data collected by the downhole tool 136 in accordance with embodiments of the present disclosure. As discussed above, embodiments of the present disclosure may be used to efficiently compress the data and significantly improve the effective data rate of the downhole telemetry according to an image imposition scheme implemented by the downhole tool 136 and a downhole memory associated with the downhole tool 136. In some embodiments, to implement the image imposition scheme, a shape, a size, and/or a location of the reference shape 204 may be altered to select a shape that most closely matches the first shape 206. The shape may be selected to minimize an area between the initial sensor data and the actual sensor data to minimize the number of the bits being transmitted and to optimize the telemetry data rate. This may be done by comparing the first shape 206 against a set of pre-determined reference shapes stored in a library of the downhole memory to select a pre-determined reference shape 302 (i.e., most closely matches) that can be imposed on the first shape 206.

To facilitate such comparisons, the characteristics of the reference shape 302 or any other shape may be selected/modified by various methods. In some embodiments, the pre-determined reference shape 302 may be selected from a plurality of pre-determined shapes stored in the library. The library may have the plurality of the pre-determined shapes that differ from each other in the values of one or more parameters of the formation. The downhole tool 136 may evaluate and determine which of the pre-determined shapes to be used that can be closely imposed on the first shape 206 on the plot 300A. In some embodiments, the downhole tool 136 may be programmed to transmit the predetermined reference shape, or a code and/or a size of the pre-determined reference shape to the processor 138 at the surface. In some embodiments, the downhole tool 136 may be programmed to transmit a phase and a magnitude of a sine wave function to the processor 138 at the surface to determine a reference shape (e.g., a circle/oval) to be closely imposed on the first shape 206. In some examples, the information may be formatted into binary data for transmission uphole. The processor 138 may then decode the information from downhole to obtain the series of the data.

As can be observed from PG. 3A, an area difference between the pre-determined reference shape 302 and the first shape 206 in FIG. 3A is small in comparison to the area difference between the reference shape 202 and the first shape 206 in FIG. 2. The pre-determined reference shape 302 may be subtracted from the first shape 206 (or vice versa) to produce the delta values. The number of bits required to represent these delta values have become smaller to transmit the information/data to the uphole and hence, improve the effective data rate. In addition to transmitting the delta values from the downhole to the surface of the wellbore 116 in real-time, the pre-determined reference shape 302, the code, the size, or a location may also be transmitted from the downhole to the processor 138. The processor 138 may then decode the information from the downhole to obtain the series of the data. As this method minimizes the delta values to be transmitted, it may be possible to increase the quality of the pre-determined reference shape 302 to be transmitted.

Figure 3B:
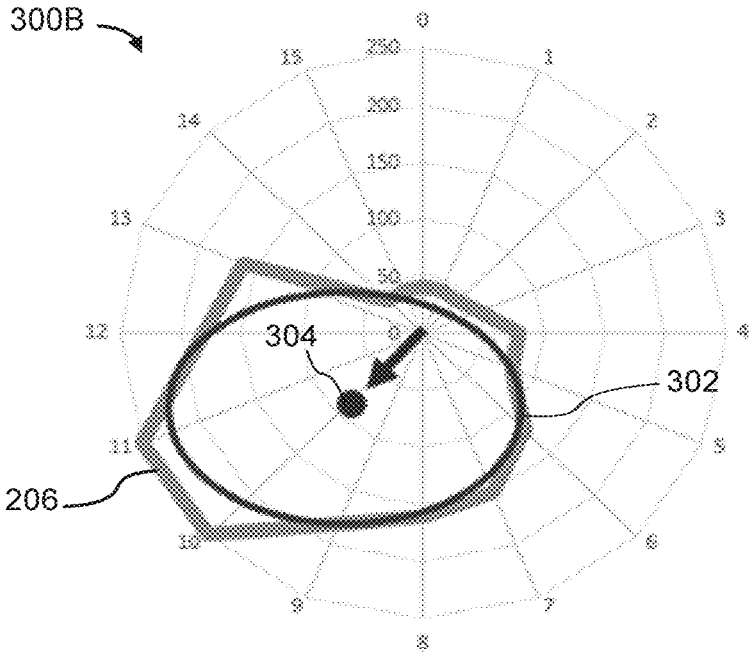
FIG. 3B illustrates another polar plot of sensor data collected by a downhole tool in accordance with embodiments of the present disclosure.

FIG. 3B illustrates another polar plot 300B of sensor data collected by the downhole tool 136 in accordance with embodiments of the present disclosure. In some embodiments, an angle at which the deviation from the reference shape 204 occurs and/or the magnitude of the deviation may be used to determine a location and direction of the pre-determined reference shape 302. As can be observed from FIG. 3B, the pre-determined reference shape/circle 302 is best fitted when the center of the pre-determined reference shape/circle is moved to the direction 304 of 10 by —100 in magnitude. As a result, the area difference/delta data between the pre-determined reference shape and the shape formed by the actual sensor data may become much smaller and the number of bits required to be transmitted to the surface become smaller. Thus, transmitting a location of the pre-determined reference shape along with delta data to the processor 138 may improve the effective data rate.

In some embodiments, the pre-determined reference shape 302 may be optimized by reducing the resolution of the location information. As discussed above, the downhole telemetry may have limited bandwidth. Increasing the resolution of the location of the pre-determined reference shape 302 may increase the burden on downhole telemetry. Thus, instead of determining accurate locations, the location of the pre-determined reference shape 302 may be determined "roughly close" to the first shape 206 to reduce the bandwidth requirements to transmit the shape location information e.g., a direction and magnitude) to the surface.

In some examples, the pre-determined reference shape may be selected from 32 images stored in the library, 16 different directions, and 8 different values for magnitude. In one example, the downhole tool 136 may require a maximum of 56 bits to transmit the image for imposition. The disclosed methods may be applied to any formation property measurements, downhole imaging, or any other measurements that have a series of data. The rate of compression increases as more data gets compressed since the initial transmission of shape and its location becomes an investment.

Consider for purposes of explanation, and with reference to Table 1 below, a comparison of number of bits required to transmit by the downhole tool 136 to the processor 138 at the surface by the conventional compression method and the disclosed image imposition method may be illustrated. Table 1 shows the effectiveness of the disclosed image imposition method in reducing the number of bits required to transmit the sensor data from the downhole to the surface of the wellbore, and increasing the effective data throughput. As exemplified in Table 1, column 2 may represent the numeric values received from raw sensor data. The raw sensor data may be collected as the downhole tool 136 rotates within the borehole and binned into a plurality of azimuthal bins according to the azimuthal direction in which the downhole tool 136 was positioned when the raw sensor data was acquired. For example, sixteen bins from 0-15 in column 1 are shown in Table 1. However, in general, any number of bins may be used. In the conventional delta compression method, the delta values (e.g. in column 3) may be determined by calculating a difference between the reference shape 202 and the first shape 206 as shown in FIG. 2. As discussed above, in the disclosed image imposition method, the delta values (e.g., in column 4) may be calculated by observing a difference between the pre-determined reference shape 302 and the first shape 206 as shown in FIG. 3A. As eater piffled in Table 1, the delta values (e.g., in column 4) calculated using the image imposition method may require a very small number of bits (e.g., 290) in comparison to number of bits (e.g., 1220) required in the conventional compression method. Thus, the disclosed image imposition method may significantly reduce the number of bits required to transmit the sensor data from the downhole to the surface of the wellbore 116 and increase the effective data throughput.

TABLE 1

| Bin | Raw Sensor Data | Conventional Delta Compression Method | Image Imposition Method |
|---|---|---|---|
| 0 | 40 | 0 | 15 |
| 1 | 40 | 0 | 18 |
| 2 | 40 | 0 | 17 |
| 3 | 50 | 10 | 20 |
| 4 | 80 | 40 | 30 |
| 5 | 80 | 40 | 5 |
| 6 | 120 | 80 | 0 |
| 7 | 150 | 110 | 10 |
| 8 | 160 | 120 | 5 |
| 9 | 180 | 140 | 0 |
| 10 | 250 | 210 | 35 |
| 11 | 250 | 210 | 25 |
| 12 | 180 | 140 | 20 |
| 13 | 160 | 120 | 70 |
| 14 | 40 | 0 | 10 |
| 15 | 40 | 0 | 10 |
| Sum (Bits transmitted) | 1860 | 1220 | 290 |

Figure 4:
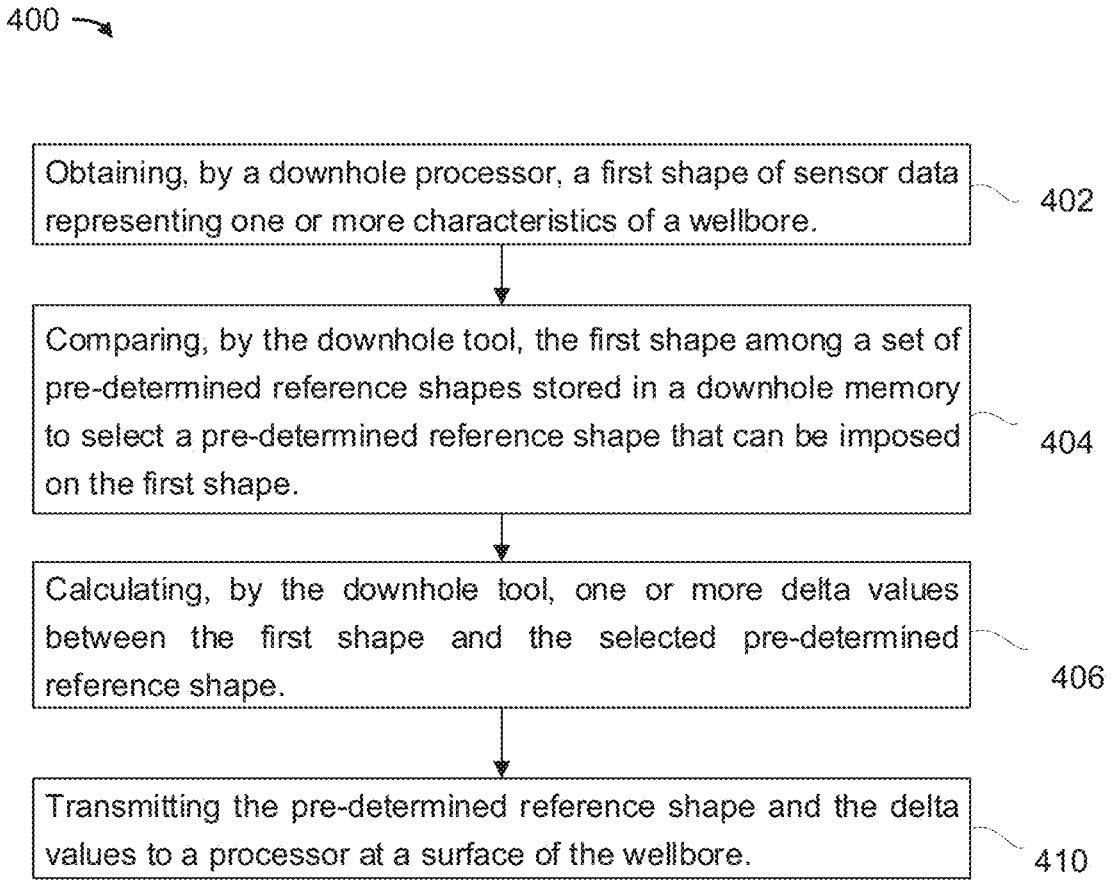
FIG. 4 illustrates a flow chart of an exemplary method of data compression using an image imposition technique in accordance with embodiments of the present disclosure.

FIG. 4 illustrates a flow chart of an exemplary method 400 for downhole compressing of data using an image imposition method in accordance with embodiments of the present disclosure. For discussion purposes, the image imposition method provided in this embodiment of this application may be performed by the downhole tool 136. The downhole tool 136 may comprise a downhole processor 138 (e.g., a digital signal processor (DSP) or the like). This is not limited in this embodiment of this application. The method may be implemented by using the following steps 402 to 408.

At step 402, the method 400 may comprise obtaining, by the downhole tool 136, the first shape 206 of sensor data representing one or more characteristics of a wellbore. In one embodiment, the sensor data may be raw sensor data determined based on measurements obtained from an angle sensor incorporated within the downhole tool 136.

At step 404, the method 400 may comprise comparing, by the downhole tool 136, the first shape among a set of pre-determined reference shapes stored in a downhole memory so as to select a pre-determined reference shape that can be imposed on the first shape 206. The pre-determined reference shape 302 may comprise any form of shapes including a circle, an oval, a rectangle, or an eclipse. In one embodiment, the method may further comprise selecting the pre-determined reference shape that closely matches the first shape 206 and/or that minimizes an area between the first shape 206 and the pre-determined reference shape 302.

At step 406, the method 400 may comprise calculating one or more delta values between the first shape 206 and the selected pre-determined reference shape 302.

At step 408, the method may comprise transmitting the pre-determined reference shape 302 and the delta values to the processor 138 at a surface of the wellbore 116. In one embodiment, the method may further comprise transmitting the pre-determined reference shape 302, size and/or a code of the pre-determined reference shape 302, or a location of the pre-determined reference shape 302 to the processor 138 in real-time during a drilling operation or a logging operation.

In some further embodiments of this disclosure, a delta value compression system and method may be utilized to group the data that measures similar formation properties to reduce the data bandwidth requirements. In general, a well trajectory data such as inclination data and azimuth data may change very little between subsequent samples. Hence, instead of transmitting the full values every time, transmitting a full value from one measurement and transmit a delta value from the other measurement, may be a more effective way of reducing the number of bits to be transmitted and improving the data rate/bandwidth. Furthermore, in following datasets, transmitting a delta value based on a difference between previously transmitted data and current data may further reduce the bandwidth requirements. Thus, grouping the data that measures similar formation properties may reduce the data bandwidth requirements.

To implement this, the downhole tool 136 may receive downhole measurements from a plurality of downhole sensors that measure similar formation properties during a downhole drilling operation in the wellbore 116, wherein the sensors are disposed on the drill string 108 at different locations. The plurality of sensors may comprise at-bit inclination sensor, a survey senor, a pressure sensor, a directional sensor, and/or a resistivity sensor. In some embodiments, the downhole tool 136 may receive a first measurement from a first downhole sensor and a second measurement from a second downhole sensor of the plurality of downhole sensors. The downhole tool 136 may calculate a first delta value between the first measurement and the second measurement, and may transmit the first measurement and the first delta value to the processor 138 at the surface of the wellbore 116. In some embodiments, the downhole tool 136 may receive a third measurement from the first downhole sensor, calculate a second delta value between the third measurement and the transmitted first measurement, and transmit the first delta value and the second delta value to the processor 138. In this way, grouping the data that measures similar formation properties may reduce the data bandwidth requirements.

Consider for purposes of explanation, two exemplary types of telemetry data A and B may be referred as shown in Table 2 below.

TABLE 2

| Survey Sensor inclination | At bit inclination sensor | Delta |
|---|---|---|
| 89.52 | 89.52 | 0 |
| 89.61 | 89.61 | 0 |
| 89.61 | 89.61 | 0 |
| 89.52 | 89.61 | 0.09 |
| 89.52 | 89.61 | 0.09 |
| 89.52 | 89.61 | 0.09 |
| 89.52 | 89.61 | 0.09 |
| 89.61 | 89.61 | 0 |
| 89.61 | 89.61 | 0 |
| 89.61 | 89.61 | 0 |
| 89.61 | 89.61 | 0 |
| 89.61 | 89.7 | 0.09 |
| 89.61 | 89.7 | 0.09 |

As exemplified in Table 2, data type A (e.g., column 1) may be the measurements received from the survey sensor and data type B (e.g., column 2) may be measurements received from the at-bit inclination sensor. Both data types A and B may measure similar formation properties of the formation. As exemplified in Table 2, the data values of the survey sensor and at-bit inclination sensor are different, however, a delta value (e.g., value in column 3) which is a difference between two data values (column 3) is much less than the magnitude of the data values. In some cases, data type A has experienced no change in value from the value from data type B, then the preferred embodiments only a data value of zero may be sent. Likewise, if parameter A experiences only a small change in value from the value of parameter B, a number representing the change in value may be transmitted to the surface. This change in value, or delta value, may require fewer bits therefore, the overall number of bits to transfer the information is reduced, increasing the effective data throughput. Furthermore, in some embodiments, the data transmitted onwards may be the delta from the initial value. In some cases, the data may be re-calibrated after a certain number of data transmissions.

Figure 5:
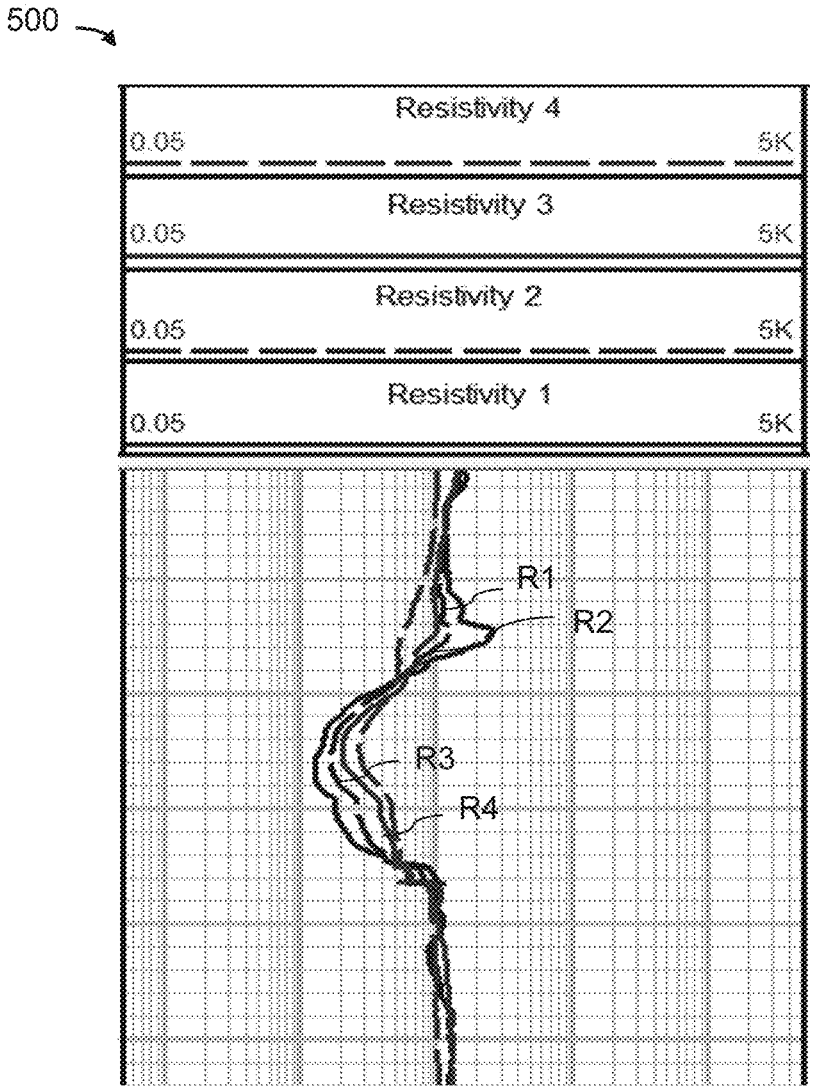
FIG. 5 illustrates a graph showing responses of multi-frequency and multi-spacing resistivity measurements in accordance with embodiments of the present disclosure.

FIG. 5 illustrates an example representation 500 of responses of multi-frequency and/or multi-spacing resistivity in accordance with embodiments of the present disclosure. In some alternative embodiments, transmitting delta values may minimize the volume of resistivity data to be transmitted. The resistivity logging tool may be placed in a borehole and when drilling commences, the downhole tool 136 can be rotated and can collect measurements excited by multi-spacing and multi-frequency current source transmitters. Measurement along the 360 degrees of rotation may be obtained while the downhole tool 136 rotates at the same position in the borehole. These measurements with respect to different frequency and spacing may have different sensitivities to formation parameters and different detection abilities even for the same parameter. A multi-frequency and/or multi-spacing resistivity tool may measure the formation resistivity with various spacing and frequencies. For example, as can be observed from the graph 500, four different resistivity measurements values R1, R2, R3, and R4 have been observed at various spacing. Although the measurements may be different between the different frequencies, spacing, phase/attenuation, the difference between those measurements is much less than the difference between zero and the measured values. Thus, selecting one measurement as a reference data point and transmitting delta for other measurements may also minimize the volume of data to be transmitted. This method may be used for any tools that provide similar measurements. To implement this method, the resistivity logging tool deployed in the wellbore 116 may obtain at least two resistivity measurements at different orientations. Then, the downhole tool may calculate delta values between the at least two resistivity measurements. The downhole tool may transmit at least one resistivity measurement and the delta values to the processor at the surface of the wellbore. In one case, the resistivity measurements may be obtained by a plurality of spaced transmitters and receivers of the resistivity logging tool using multiple frequencies.

Figure 6:
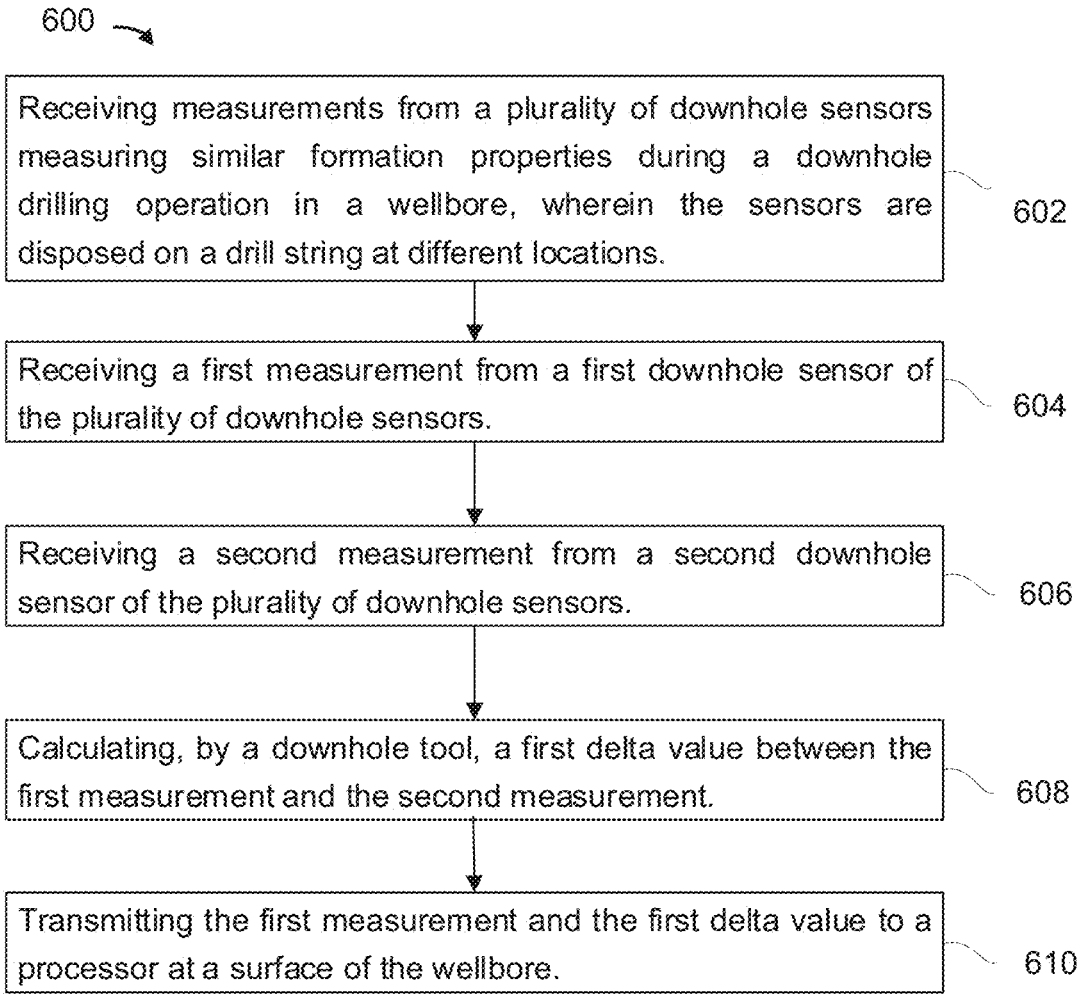
FIG. 6 illustrates a flow chart of an exemplary method of data compression in accordance with embodiments of the present disclosure FIG. 7 conceptually illustrates an electronic system in accordance with embodiments of the present disclosure.

FIG. 6 illustrates a flow chart of an exemplary method 600 for downhole compressing of data in accordance with embodiments of the present disclosure. As discussed above, the method 600 may be implemented to group the data that measures similar formation properties to reduce the data bandwidth requirements. For discussion purposes, the method 600 provided in this embodiment may be performed a plurality of sensors measuring similar formation properties during a downhole drilling operation in a wellbore. The sensors may comprise at-bit inclination sensor, a survey sensor, a pressure sensor, a directional sensor, a resistivity sensor, or the like. This is not limited in this embodiment of this application. The method may be implemented by using the following steps 602 to 610.

At step 602, the method 600 may comprise receiving measurements from a plurality of downhole sensors measuring similar formation properties during a downhole drilling operation in a wellbore, wherein the sensors are disposed on the drill string 108 at different locations. In one embodiment, the sensors are configured to collect information regarding the formation around a borehole and/or trajectory of the wellbore 116.

At step 604, the method 600 may comprises receiving a first measurement from a first downhole sensor of the plurality of downhole sensors.

At step 606, the method 600 may comprises receiving a second measurement from a second downhole sensor of the plurality of downhole sensors.

At step 608, the method 600 may comprise calculating, by the downhole tool 136, a first delta value between the first measurement and the second measurement.

At step 610, the method may comprise transmitting the first measurement and the first delta value to the processor 138 at the surface of the wellbore 116. In one embodiment, the method may further comprise receiving a third measurement from the first downhole sensor, calculating a second delta value between the third measurement and the transmitted first measurement, and transmitting the first delta value and the second delta value to the processor 138.

Figure 7:
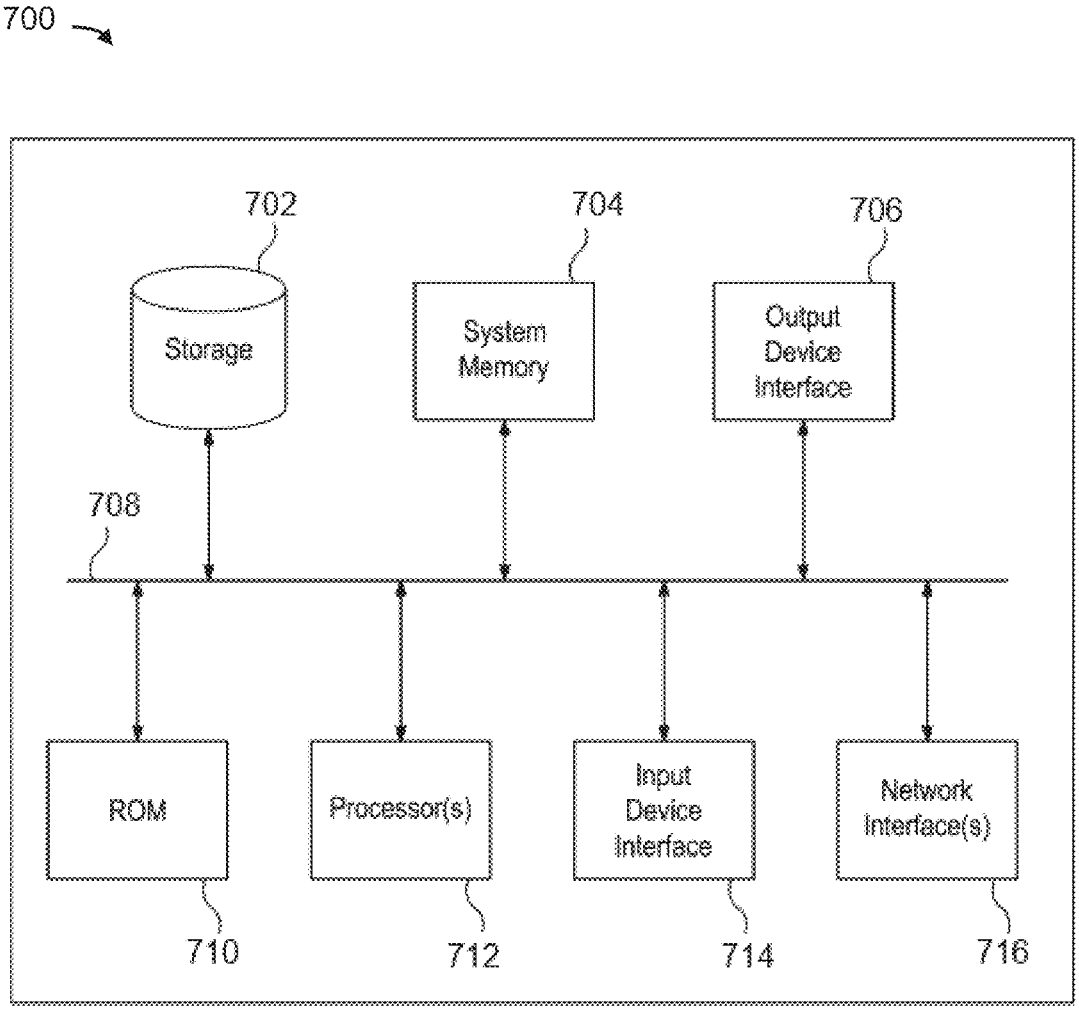

FIG. 7 conceptually illustrates an electronic system 700 with which one or more implementations of the present disclosure may be implemented. The electronic system 700, for example, may be, or may be coupled to, a sensor system, a desktop computer, a laptop computer, a tablet computer, a server, a receiver, or generally any electronic device that receives and transmits signals over a network. The electronic system 700 can be a part of the downhole tool 136. Such an electronic system includes various types of computer readable media and interfaces for various other types of computer readable media. The electronic system 700 includes a bus 708, one or more processor(s) 712, a system memory 704 or buffer, a read-only memory (ROM) 710, a permanent storage device 702, an input device interface 714, an output device interface 706, and one or more network interface(s) 716, or subsets and variations thereof.

The bus 708 collectively represents all system, peripheral, and chipset buses that communicatively connect the numerous internal devices of the electronic system 700. In one or more implementations, the bus 708 may comprise a mud system through which the surface and downhole processing units communicate. In one or more implementations, the bus 708 communicatively connects the one or more processor(s) 712 with the ROM 710, the system memory 704, and the permanent storage device 702. From these various memory units, the one or more processor(s) 712 retrieve instructions to execute and data to process in order to execute the processes of the present disclosure. The one or more processor(s) 712 can be a single processor or a multi-core processor in different implementations.

The ROM 710 stores static data and instructions that are needed by the one or more processor(s) 712 and other modules of the electronic system 700. The permanent storage device 702, on the other hand, may be a read-and-write memory device. The permanent storage device 702 may be a non-volatile memory unit that stores instructions and data even when the electronic system 700 is off. In one or more implementations, a mass-storage device (such as a magnetic or optical disk and its corresponding disk drive) may be used as the permanent storage device 702.

In one or more implementations, a removable storage device (such as a floppy disk, flash drive, and its corresponding disk drive) may be used as the permanent storage device 702. Like the permanent storage device 702, the system memory 704 may be a read-and-write memory device. However, unlike the permanent storage device 702, the system memory 704 may be a volatile read-and-write memory, such as random access memory. The system memory 704 may store any of the instructions and data that one or more processor(s) 712 may need at runtime. In one or more implementations, the processes of the present disclosure are stored in the system memory 704, the permanent storage device 702, and/or the ROM 710. Fro these various memory units, the one or more processor(s) 712 retrieve instructions to execute and data to process in order to execute the processes of one or more implementations.

The bus 708 also connects to the input device interface 714 and the output device interface 706. The input device interface 714 enables a user to communicate information and select commands to the electronic system 700. Input devices that may be used with the input device interface 714 may include, for example, alphanumeric keyboards and pointing devices. The output device interface 706 may enable, for example, the display of images generated by the electronic system 700. Output devices that may be used with the output device interface 706 may include, for example, printers and display devices, such as a liquid crystal display (LCD), a light emitting diode (LED) display, an organic light emitting diode (OLEIC) display, a flexible display, a flat panel display, a solid state display, a projector, or any other device for outputting information. One or more implementations may include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

The bus 708 also may couple the electronic system 700 to one or more networks (not shown) through one or more network interface(s) 716. One or more network interface(s) may include an Ethernet interface, a Wi-Fi interface, or generally any interface for connecting to a network. In this manner, the electronic system 700 can be a part of one or more networks of computers (such as a local area network ("LAN"), a wide area network ("WAN"), or an Intranet, or a network of networks, such as the Internet. Any or all components of the electronic system 600 can be used in conjunction with the present disclosure.

The electronic system 700 is suitable for collecting, processing and displaying logging data. In one or more implementations, a user can interact with the electronic system 700 via the input device interface 714 to send one or more commands to drilling assembly 100 to adjust its operation in response to received logging data. In one or more implementations, the downhole tool 136 is coupled to the processor 712 via the bus 708 to enable the electronic system 700 to communicate with the drill assembly 100 including the drill bit 114. In accordance with user input received via the input device interface 714 and program instructions from the system memory 704 and/or the ROM 710, the processor 712 processes the received telemetry information received via the network interface 716 over the bus 708. The processor 712 can construct formation property logs (including one or more borehole wall images), and display them to the user via the output device interface 706.

ADDITIONAL DISCLOSURE

The following are non-limiting, specific embodiments in accordance with the present disclosure:

A first embodiment, which is a method, comprising obtaining, by a downhole processor, a first shape of sensor data representing one or more characteristics of a wellbore, comparing, by the downhole tool, the first shape with a set of pre-determined reference shapes stored in a downhole memory to select a pre-determined reference shape that can be imposed on the first shape, calculating one or more delta values between the first shape and the selected pre-determined reference shape, and transmitting the pre-determined reference shape and the delta values to a processor at a surface of the wellbore.

A second embodiment, which is the method of the first embodiment, further comprising selecting the pre-determined reference shape comprises selecting the pre-determined reference shape that minimizes an area between the first shape and the pre-determined reference shape.

A third embodiment, which is the method of any of the first and the second embodiments, further comprising selecting the pre-determined reference shape comprises selecting the pre-determined reference shape that closely matches the first shape.

A fourth embodiment, which is the method of any of the first through the third embodiments, further comprising transmitting a code and/or size of the pre-determined reference shape and the delta values to the processor via the downhole tool.

A fifth embodiment, which is the method of any of the first through the fourth embodiments, further comprising transmitting a magnitude and a phase of a sine-wave function and the delta values to the processor via the downhole tool.

A sixth embodiment, which is the method of any of the first through the fifth embodiments, further comprising transmitting a magnitude and/or a location of the pre-determined reference shape and the delta values to the processor via the downhole tool.

A seventh embodiment, which is the method of any of the first through the sixth embodiments, further comprising transmitting the pre-determined reference shape, size and/or a code of the pre-determined reference shape, or a location of the pre-determined reference shape to the processor in real-time during a drilling operation or a logging operation.

An eighth embodiment, which is the method of any of the first through the seventh embodiments, wherein the pre-determined reference shape may comprise a circle, an oval, a rectangle, or an ellipse.

A ninth embodiment, which is the method of any of the first through the eighth embodiments, further comprising determining the sensor data by the downhole tool at different points around a circumference of the wellbore drilled within a formation at a selected depth.

A tenth embodiment, which is the method of any of the first through the ninth embodiments, further comprising assigning the delta values to a plurality of azimuthal bins, wherein each azimuthal bin corresponding to an angular sector around the circumference of the wellbore.

An eleventh embodiment, which is the method of any of the first through the tenth embodiments, wherein the sensor data may be determined based on measurements obtained from an angle sensor incorporated within the downhole tool.

A twelfth embodiment, which is the method of any of the first through the eleventh embodiments, wherein the sensor data may comprise one or more of azimuthal density data, azimuthally focused resistivity data, azimuthally deep resistivity, azimuthal acoustic compressional and shear images, acoustic borehole caliper and reflectance, and spectral natural gamma ray and non-spectral natural gamma imaging.

A thirteenth embodiment, which is a system, comprising a downhole memory, a downhole tool coupled to the downhole memory and configured to obtain a first shape of sensor data representing one or more characteristics of a wellbore, compare the first shape with a set of pre-determined reference shapes stored in the downhole memory to select a pre-determined reference shape that can be imposed on the first shape, and calculate one or more delta values between the first shape and the selected pre-determined reference shape, and a transmitter to transmit the pre-determined reference shape and the delta values to a processor at a surface of the wellbore.

A fourteenth embodiment, which is the system of the thirteenth embodiment, further comprising a downhole sensor device configured to collect the sensor data while the downhole sensor device is within the wellbore.

A fifteenth embodiment, which is the system of any of the thirteenth through the fourteenth embodiments, wherein the downhole tool is further configured to select the pre-determined reference shape that minimizes an area between the first shape and the pre-determined reference shape.

A sixteenth embodiment, which is the system of any of the thirteenth through the fifteenth embodiments, wherein the downhole tool is further configured to select the pre-determined reference shape that closely matches the first shape.

A seventeenth embodiment, which is the system of any of the thirteenth through the sixteenth embodiments, wherein the transmitter is further configured to transmit a code and/or a size of the pre-determined reference shape and the delta values to the processor via the downhole tool.

An eighteenth embodiment, which is the system of any of the thirteenth through the seventeenth embodiments, wherein the transmitter is further configured to transmit a magnitude and a phase of a sine-wave function and the delta values to the processor via the downhole tool.

A nineteenth embodiment, which is the system of any of the thirteenth through the eighteenth embodiments, wherein the transmitter is further configured to transmit a magnitude and/or a location of the pre-determined reference shape and the delta values to the processor via the downhole tool.

A twentieth embodiment, which is the system of any of the thirteenth through the nineteenth embodiments, wherein the transmitter is further configured to transmit the pre-determined reference shape, a size and/or a code of the pre-determined reference shape, or a location of the pre-determined reference shape to the processor in real-time during a drilling operation or a logging operation.

A twenty-first embodiment, which is the system of any of the thirteenth through the twentieth embodiments, wherein the pre-determined reference shape comprises a circle, an oval, a rectangle, or an ellipse.

A twenty-second embodiment, which is the system of any of the thirteenth through the twenty-first embodiments, further comprising a downhole sensor configured to collect the sensor data at different points around a circumference of the wellbore drilled within a formation at a selected depth.

A twenty-third embodiment, which is the system of any of the thirteenth through the twenty-second embodiments, wherein the downhole tool is further configured to assign the delta values to a plurality of azimuthal bins, wherein each azimuthal bin corresponding to an angular sector around the circumference of the wellbore.

A twenty-fourth embodiment, which is the system of any of the thirteenth through the twenty-third embodiments, wherein the sensor data determined based on measurements obtained from an angle sensor incorporated within the downhole tool.

A twenty-fifth embodiment, which is the system of any of the thirteenth through the twenty-fourth embodiments, wherein the sensor data comprises one or more of azimuthal density data, azimuthally focused resistivity data, azimuthally deep resistivity, azimuthal acoustic compressional and shear images, acoustic borehole caliper and reflectance, and spectral natural gamma ray and non-spectral natural gamma imaging.

A twenty-sixth embodiment, which is a method, comprising receiving measurements from a plurality of downhole sensors measuring similar formation properties during a downhole drilling operation in a wellbore, wherein the sensors are disposed on a drill string at different locations, receiving a first measurement from a first downhole sensor of the plurality of downhole sensors, receiving a second measurement from a second downhole sensor of the plurality of downhole sensors, calculating, by a downhole tool, a first delta value between the first measurement and the second measurement, and transmitting the first measurement and the first delta value to a processor at a surface of the wellbore.

A twenty-seventh embodiment, which is the method of the twenty-sixth embodiment, further comprising receiving a third measurement from the first downhole sensor, calculating a second delta value between the third measurement and the transmitted first measurement, and transmitting the first delta value and the second delta value to the processor.

A twenty-eighth embodiment, which is the method any of the twenty-sixth and the twenty-seventh embodiments, wherein the sensors are configured to collect information regarding a formation around a borehole and/or trajectory of the wellbore.

A twenty-ninth embodiment, which is the method of any of the twenty-sixth through the twenty-eighth embodiments, wherein the sensors comprise at-bit inclination sensor, a survey sensor, a pressure sensor, a directional sensor, and/or a resistivity sensor.

A thirtieth embodiment, which is the method of any of the twenty-sixth through the twenty-ninth embodiments, wherein the formation properties comprise information regarding a formation around a borehole and/or trajectory of the wellbore.

A thirty-first embodiment, which is a method, comprising obtaining at least two resistivity measurements at different orientations of a resistivity logging tool deployed in a wellbore, calculating delta values between the at least two resistivity measurements, and transmitting at least one resistivity measurement and the delta values to a processor at a surface of the wellbore.

A thirty-second embodiment, which is the method of the thirty-first embodiment, wherein the at least two resistivity measurements are obtained by a plurality of spaced transmitters and receivers of the resistivity logging tool using multiple frequencies.

A thirty-third embodiment, which is a non-transitory computer readable medium, comprising a computer program product for use by a downhole tool, the computer program product comprising computer executable instructions stored on the non-transitory computer readable medium such that when executed by a processor cause the downhole tool to perform the disclosed method.

A thirty-fourth embodiment, which is a system, comprising a storage means including instructions, a processing means coupled to the storage means, the processing means configured to implement the instructions to cause a downhole hole to obtain a first shape of sensor data representing one or more characteristics of a wellbore, compare the first shape with a set of pre-determined reference shapes stored in the downhole memory to select a pre-determined reference shape that can be imposed on the first shape, and calculate one or more delta values between the first shape and the selected pre-determined reference shape, and a transmitting means coupled to the processing means, the transmitting means configured to transmit the pre-determined reference shape and the delta values to a processor at a surface of the wellbore.

While embodiments have been shown and described, modifications thereof can be made by one skilled in the art without departing from the spirit and teachings of this disclosure. The embodiments described herein are exemplary only, and are not intended to be limiting, Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim, Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method, comprising:

obtaining, by a downhole tool and from a sensor incorporated within the downhole tool, a first shape of sensor data representing one or more characteristics of a wellbore arranged on a polar plot;

selecting, by the downhole tool, a pre-determined shape from a set of pre-determined reference shapes stored in a downhole memory that matches the first shape;

imposing the pre-determined shape on the first shape arranged on the polar plot;

adjusting, by a user at a surface of the wellbore, a shape, a size, and a location of the pre-determined shape to minimize an area between the first shape and the pre-determined shape;

calculating, by the downhole tool, one or more delta values between the first shape and the adjusted pre-determined shape; and transmitting, by a downhole transmitter, the adjusted pre-determined shape and the delta values to a processor at a surface of the wellbore.

2. The method of claim 1, wherein selecting the pre-determined shape comprises selecting the pre-determined shape that matches the first shape.

3. The method of claim 1, further comprising transmitting, by the downhole transmitter, a code and/or size of the pre-determined shape to the processor.

4. The method of claim 1, further comprising transmitting, by the downhole transmitter, a magnitude and a phase of a sine-wave function to the processor.

5. The method of claim 1, further comprising transmitting, by the downhole transmitter, a magnitude and/or a location of the pre-determined shape to the processor.

6. The method of claim 1, further comprising transmitting the pre-determined shape, size and/or a code of the pre-determined shape, or a location of the pre-determined shape to the processor in real-time during a drilling operation or a logging operation.

7. The method of claim 1, wherein the pre-determined shape comprises a circle, an oval, a rectangle, or an ellipse.

8. The method of claim 1, further comprising determining the sensor data by the downhole tool at different points around a circumference of the wellbore drilled within a formation at a selected depth.

9. The method of claim 8, further comprising assigning the delta values to a plurality of azimuthal bins, wherein each azimuthal bin corresponding to an angular sector around the circumference of the wellbore.

10. The method of claim 1, wherein the sensor data is determined based on measurements obtained from an angle sensor incorporated within the downhole tool.

11. The method of claim 1, wherein the sensor comprises an at-bit inclination sensor, a survey sensor, a pressure sensor, a directional sensor, or a resistivity sensor.

12. The method of claim 1, further comprising calculating the one or more delta values by subtracting the adjusted pre-determined shape from the first shape.

13. A system, comprising:

a downhole memory;

a downhole sensor device;

a downhole tool coupled to the downhole memory and the downhole sensor device, and configured to:

obtain, from the downhole sensor device, a first shape of sensor data representing one or more characteristics of a wellbore arranged on a polar plot;

select a pre-determined shape from a set of pre-determined shapes stored in a downhole memory that matches the first shape;

impose the pre-determined shape on the first shape arranged on the polar plot;

adjust, by a user at a surface of the wellbore, a shape, a size, and a location of the pre-determined shape to minimize an area between the first shape and the pre-determined shape; and calculate one or more delta values between the first shape and the adjusted pre-determined shape; and a transmitter to transmit the adjusted pre-determined shape and the delta values to a processor at a surface of the wellbore.

14. The system of claim 13, wherein the downhole sensor device is configured to collect the sensor data while the downhole sensor device is within the wellbore.

15. The system of claim 13, wherein the transmitter is further configured to transmit a code and/or a size of the pre-determined shape to the processor via the downhole tool in real-time during a drilling operation or a logging operation.

16. The system of claim 13, wherein the transmitter is further configured to transmit a magnitude and a phase of a sine-wave function to the processor via the downhole tool in real-time during a drilling operation or a logging operation.

17. The system of claim 13, wherein the transmitter is further configured to transmit a magnitude and/or a location of the pre-determined shape to the processor via the downhole tool in real-time during a drilling operation or a logging operation.

18. The system of claim 13, wherein the pre-determined shape comprises a circle, an oval, a rectangle, or an ellipse.

19. The system of claim 13, wherein the sensor comprises an at-bit inclination sensor, a survey sensor, a pressure sensor, a directional sensor, or a resistivity sensor.

20. The system of claim 13, wherein the downhole tool is further configured to calculate the one or more delta values by subtracting the adjusted pre-determined shape from the first shape.

* * * * *